US011179728B2

(12) United States Patent
Terry et al.

(10) Patent No.: US 11,179,728 B2
(45) Date of Patent: Nov. 23, 2021

(54) APPARATUS AND METHOD FOR AN ADJUSTABLE TOGGLE ASSEMBLY

(71) Applicant: Telsmith, Inc., Mequon, WI (US)

(72) Inventors: Josh Terry, Germantown, WI (US); Lodewikus van der Walt, Boksburg (ZA); Mike Thompson, Milwaukee, WI (US)

(73) Assignee: Telsmith, Inc., Mequon, WI (US)

( * ) Notice: Subject to any disclaimer, the term of this patent is extended or adjusted under 35 U.S.C. 154(b) by 117 days.

(21) Appl. No.: 16/710,386

(22) Filed: Dec. 11, 2019

(65) Prior Publication Data

US 2020/0179936 A1 Jun. 11, 2020

Related U.S. Application Data

(60) Provisional application No. 62/778,111, filed on Dec. 11, 2018.

(51) Int. Cl.
*B02C 1/04* (2006.01)

(52) U.S. Cl.
CPC ..... *B02C 1/04* (2013.01)

(58) Field of Classification Search
CPC .... B02C 1/02; B02C 1/04; B02C 1/06; B02C 1/043
USPC ..... 74/520
See application file for complete search history.

(56) References Cited

U.S. PATENT DOCUMENTS 843,450 A * 2/1907 Gray ..... G05G 7/04 74/520
1,133,101 A * 3/1915 Cookfield ..... B02C 1/043 241/218
2,960,276 A * 11/1960 Roubal ..... B02C 1/04 241/219
2006/0243833 A1* 11/2006 Nilsson ..... B02C 2/047 241/30

FOREIGN PATENT DOCUMENTS

GB 847424 A * 9/1960 ..... B02C 1/04
WO WO-2014086429 A1 * 6/2014 ..... B02C 1/025

* cited by examiner

*Primary Examiner* — Adam J Eiseman
*Assistant Examiner* — P Derek Pressley
(74) *Attorney, Agent, or Firm* — Chambliss, Bahner & Stophel, P.C.

(57) ABSTRACT

An adjustable toggle assembly adapted for use on an item of crushing equipment having a frame and a jaw, said adjustable toggle assembly. The assembly includes a wedge having a generally tapered configuration, a first wear bar configured to contact the wedge, and a second wear bar configured to contact the wedge. The assembly also has a first cover plate and a second cover plate. The assembly further includes a means for moving the wedge relative to the first wear bar and the second wear bar. The assembly still further includes a first toggle seat that is connected to the frame and a second toggle seat that is connected to the jaw. The means for moving the wedge relative to the first wear bar and the second wear bar is adapted to move the wedge between a contracted position and an expanded position.

17 Claims, 12 Drawing Sheets

APPARATUS AND METHOD FOR AN ADJUSTABLE TOGGLE ASSEMBLY

CROSS-REFERENCES TO RELATED APPLICATIONS/PATENTS

This application relates back to and claims the benefit of priority from U.S. Provisional Application for Pat. Ser. No. 62/778,111 titled "Toggle Assembly" and filed on Dec. 11, 2018.

FIELD OF THE INVENTION

The present invention relates generally to apparatuses and methods for toggle assemblies for crushing equipment, and particularly to apparatuses and methods for mechanical toggle assemblies for crushing equipment.

BACKGROUND AND DESCRIPTION OF THE PRIOR ART

It is known to use apparatuses and methods to adjust the setting of an item of crushing equipment using wedges. Conventional apparatuses and methods, however, suffer from one or more disadvantages. For example, conventional apparatuses and methods are undesirably complex and expensive to maintain, repair, and replace. Conventional apparatuses and methods also require undesirably large and expensive hydraulic cylinders because crushing forces are not efficiently distributed. Further, conventional apparatuses and methods require undesirably expensive and complex programmable logic controllers (PLCs) and hydraulic power units. Still further, conventional apparatuses and methods are not easily converted between mechanical toggle assemblies and hydraulic toggle assemblies. In addition, conventional apparatuses and methods have fixed-length toggles and wedges mounted on the frame of the item of crushing equipment. Also, in conventional apparatuses and methods the wedges are not wear parts. Conventional apparatuses and methods also do not have toggle assemblies that can change their length and/or the crusher setting.

It would be desirable, therefore, if an apparatus and method for an adjustable toggle assembly could be provided that would not be undesirably complex and expensive to maintain, repair, and replace. It would also be desirable if such an apparatus and method for an adjustable toggle assembly could be provided that would not require undesirably large and expensive hydraulic cylinders because crushing forces are not are not efficiently distributed. It would be further desirable if such an apparatus and method for an adjustable toggle assembly could be provided that would not require undesirably expensive and complex programmable logic controllers (PLCs) and hydraulic power units. It would be still further desirable if such an apparatus and method for an adjustable toggle assembly could be provided that would easily be converted between a mechanical toggle assembly and a hydraulic toggle assembly. In addition, it would be desirable if such an apparatus and method for an adjustable toggle assembly could be provided that would not have fixed-length toggles and wedges mounted on the frame of the item of crushing equipment. It would also be desirable if such an apparatus and method for an adjustable toggle assembly could be provided that would have wedges that are wear parts. Further, it would be desirable if such an apparatus and method for an adjustable toggle assembly could be provided that would be adapted to change their length and/or the crusher setting.

ADVANTAGES OF THE PREFERRED EMBODIMENTS OF THE INVENTION

Accordingly, it is an advantage of the preferred embodiments of the invention claimed herein to provide an apparatus and method for an adjustable toggle assembly that is not undesirably complex and expensive to maintain, repair, and replace. It is also an advantage of the preferred embodiments of the invention claimed herein to provide an apparatus and method for an adjustable toggle assembly that does not require undesirably large and expensive hydraulic cylinders because crushing forces are not are not efficiently distributed. It is another advantage of the preferred embodiments of the invention claimed herein to provide an apparatus and method for an adjustable toggle assembly that does not require undesirably expensive and complex programmable logic controllers (PLCs) and hydraulic power units. It is still another advantage of the preferred embodiments of the invention claimed herein to provide an apparatus and method for an adjustable toggle assembly that is easily converted between a mechanical toggle assembly and a hydraulic toggle assembly. It is yet another advantage of the preferred embodiments of the invention claimed herein to provide an apparatus and method for an adjustable toggle assembly that does not have fixed-length toggles and wedges mounted on the frame of the item of crushing equipment. In addition, it is an advantage of the preferred embodiments of the invention claimed herein to provide an apparatus and method for an adjustable toggle assembly that has wedges that are wear parts. It is an additional advantage of the preferred embodiments of the invention claimed herein to provide an apparatus and method for an adjustable toggle assembly that is adapted to change its length and/or the crusher setting.

Additional advantages of the preferred embodiments of the invention will become apparent from an examination of the drawings and the ensuing description.

EXPLANATION OF THE TECHNICAL TERMS

The use of the terms "a," "an," "the," and similar terms in the context of describing the invention are to be construed to cover both the singular and the plural, unless otherwise indicated herein or clearly contradicted by context. The terms "comprising" "having," "including," and "containing" are to be construed as open-ended terms (i.e., meaning "including, but not limited to,") unless otherwise noted. The terms "substantially," "generally," and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic. All methods described herein can be performed in any suitable order unless otherwise specified herein or clearly indicated by context.

Terms concerning attachments, coupling and the like, such as "attached," "connected," and "interconnected," refer to a relationship wherein structures are secured or attached to one another either directly or indirectly through intervening structures, as well as both moveable and rigid attachments or relationships, unless specified herein or clearly indicated by context. The term "operatively connected" is such an attachment, coupling or connection that allows the pertinent structures to operate as intended by virtue of that relationship.

The use of any and all examples or exemplary language (e.g., "such as," "preferred," and "preferably") herein is intended merely to better illuminate the invention and the preferred embodiments thereof, and not to place a limitation on the scope of the invention. Nothing in the specification should be construed as indicating any element as essential to the practice of the invention unless so stated with specificity. Several terms are specifically defined herein. These terms are to be given their broadest reasonable construction consistent with such definitions, as follows:

As used herein, the term "actuator" means any device, mechanism, assembly or combination thereof that is adapted to move or be moved between a retracted position and an extended position so as to impart a mechanical force. The term "actuator" includes without limitation linear actuators, rotary actuators, hydraulic cylinders, hydraulic rotary actuators, pneumatic cylinders, springs and the like.

SUMMARY OF THE INVENTION

The apparatus of the invention comprises an adjustable toggle assembly adapted for use on an item of crushing equipment having a frame and a jaw. The preferred assembly comprises a wedge having a wedge top side, a wedge bottom side, and a generally tapered configuration, a first wear bar having a first wear bar top side, a first wear bar bottom side, and being configured to contact the wedge, and a second wear bar having a second wear bar top side, a second wear bar bottom side, and being configured to contact the wedge. The preferred assembly also comprises a first cover plate that is disposed adjacent to the wedge top side, the first wear bar top side, and the second wear bar top side, and a second cover plate that is disposed adjacent to the wedge bottom side, the first wear bar bottom side, and the second wear bar bottom side. The preferred assembly further comprises a means for moving the wedge relative to the first wear bar and the second wear bar. The preferred assembly still further comprises a first toggle seat that is connected to the frame of the item of crushing equipment, and a second toggle seat that is connected to the jaw of the item of crushing equipment. In the preferred assembly, the means for moving the wedge relative to the first wear bar and the second wear bar is adapted to move the wedge between a contracted position and an expanded position, the first wear bar is adapted to contact the first toggle seat, and the second wear bar is adapted to contact the second toggle seat.

The method of the invention comprises a method for adjusting a toggle assembly adapted for use on an item of crushing equipment having a frame and a jaw. The preferred method comprises providing an adjustable toggle assembly. The preferred assembly comprises a wedge having a wedge top side, a wedge bottom side, and a generally tapered configuration, a first wear bar having a first wear bar top side, a first wear bar bottom side, and being configured to contact the wedge, and a second wear bar having a second wear bar top side, a second wear bar bottom side, and being configured to contact the wedge. The preferred assembly also comprises a first cover plate that is disposed adjacent to the wedge top side, the first wear bar top side, and the second wear bar top side, and a second cover plate that is disposed adjacent to the wedge bottom side, the first wear bar bottom side, and the second wear bar bottom side. The preferred assembly further comprises a means for moving the wedge relative to the first wear bar and the second wear bar. The preferred assembly still further comprises a first toggle seat that is connected to the frame of the item of crushing equipment, and a second toggle seat that is connected to the jaw of the item of crushing equipment. In the preferred assembly, the means for moving the wedge relative to the first wear bar and the second wear bar is adapted to move the wedge between a contracted position and an expanded position, the first wear bar is adapted to contact the first toggle seat, and the second wear bar is adapted to contact the second toggle seat. The preferred method further comprises moving the wedge between the contracted position and the expanded position.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
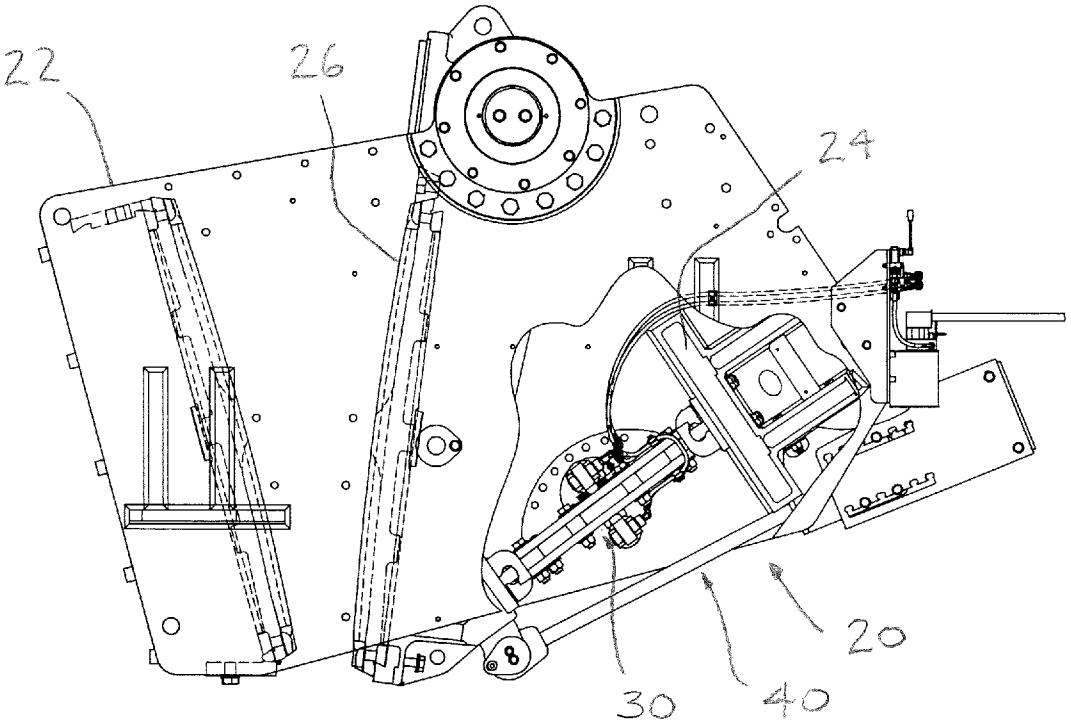
FIG. 1 is a partial sectional side view of the preferred embodiment of the adjustable toggle assembly in accordance with the present invention shown on an exemplary crusher.

Referring now to the drawings, the preferred embodiment of the adjustable toggle assembly in accordance with the present invention is illustrated by FIGS. 1 through 11. Referring now to FIG. 1, a partial sectional side view of the preferred embodiment of the adjustable toggle assembly in accordance with the present invention is illustrated on an exemplary crusher. As shown in FIG. 1, the preferred adjustable toggle assembly is designated generally by reference numeral 20 and exemplary crusher is designated generally by reference numeral 22. Preferred adjustable toggle assembly 20 is adapted for use on an item of crushing equipment such as crusher 22 having frame 24 and jaw 26. Preferred adjustable toggle assembly comprises wedge assembly 30 and tension rod assembly 40.

Figure 1A:
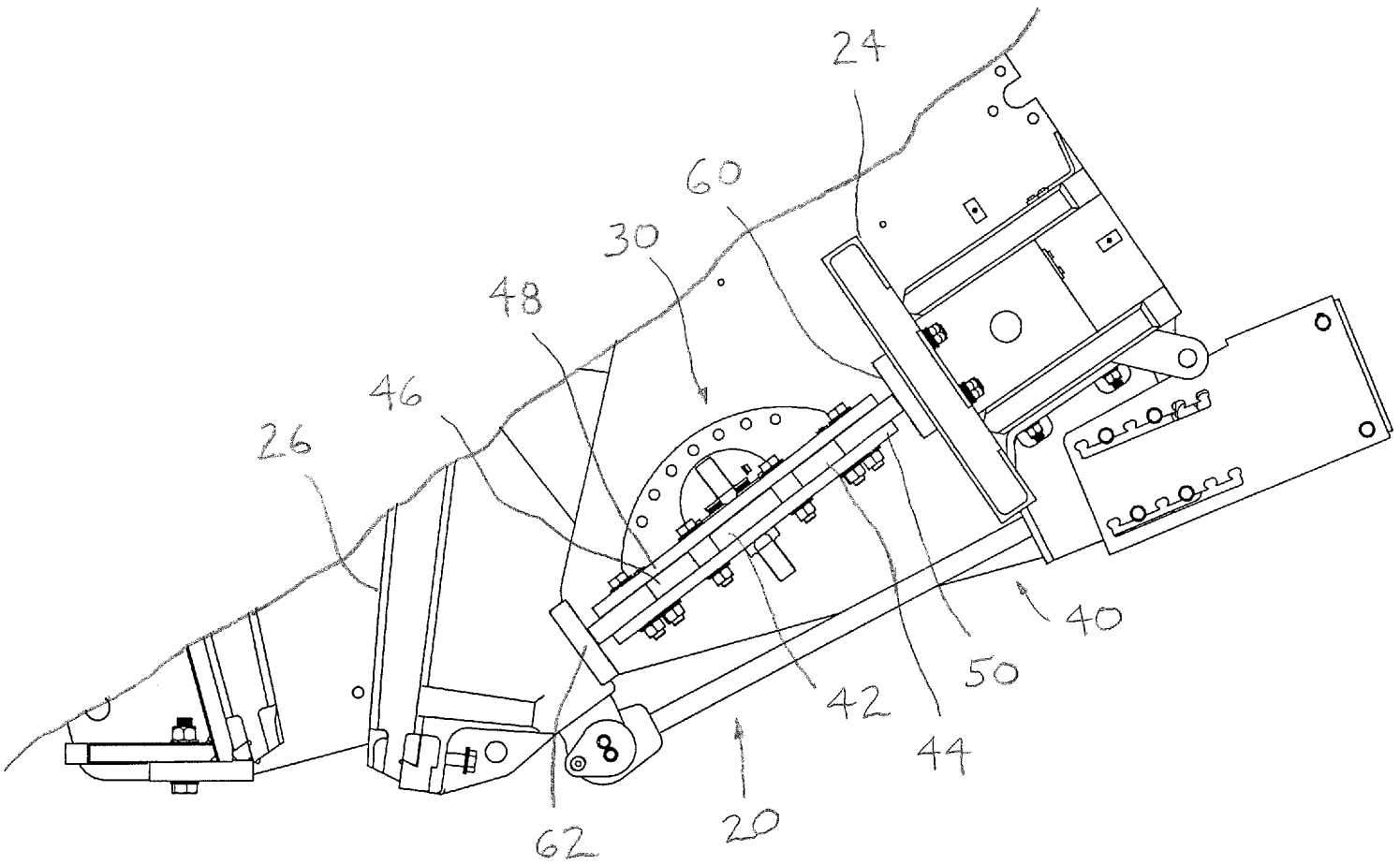
FIG. 1A is a partial sectional side view of the preferred embodiment of the adjustable toggle assembly illustrated in FIG. 1.

Referring now to FIG. 1A, a partial sectional side view of preferred adjustable toggle assembly 20 is illustrated. As shown in FIG. 1A, preferred adjustable toggle assembly 20 comprises wedge assembly 30 and tension rod assembly 40. Preferred wedge assembly 30 comprises wedge 42 having a wedge top side, a wedge bottom side, and a generally tapered configuration. Preferred wedge assembly 30 also comprises first wear bar 44 having a first wear bar top side, a first wear bar bottom side, and being configured to contact wedge 42. Preferred wedge assembly 30 further comprises second wear bar 46 having a second wear bar top side, a second wear bar bottom side, and being configured to contact wedge 42. Preferred wedge assembly 30 still further comprises first cover plate 48 which is disposed adjacent to the wedge top side, the first wear bar top side, and the second wear bar top side. In addition, preferred wedge assembly 30 comprises second cover plate 50 which is disposed adjacent to the wedge bottom side, the first wear bar bottom side, and the second wear bar bottom side.

Still referring to FIG. 1A, preferred adjustable toggle assembly 20 also comprises first toggle seat 60 which is connected to frame 24 of crusher 22, and second toggle seat 62 which is connected to jaw 26 of the crusher. In preferred adjustable toggle assembly 20, first wear bar 44 is adapted to contact first toggle seat 60, and second wear bar 46 is adapted to contact the second toggle seat 62.

Figure 2A:
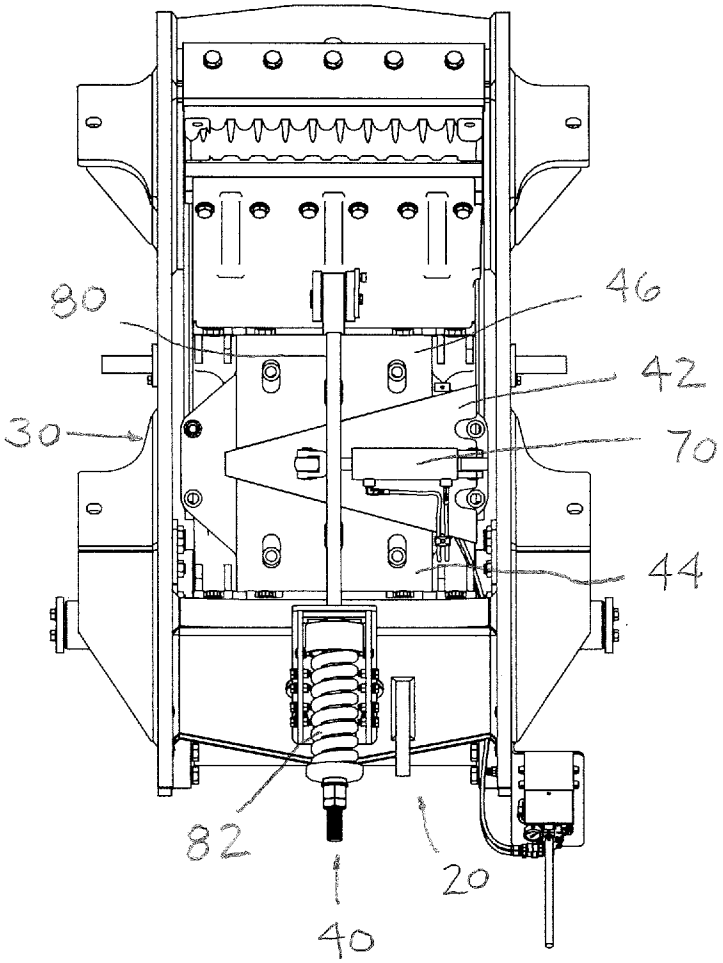
FIG. 2A is a partial sectional bottom view of the preferred adjustable toggle assembly illustrated in FIGS. 1-2.
Figure 2:
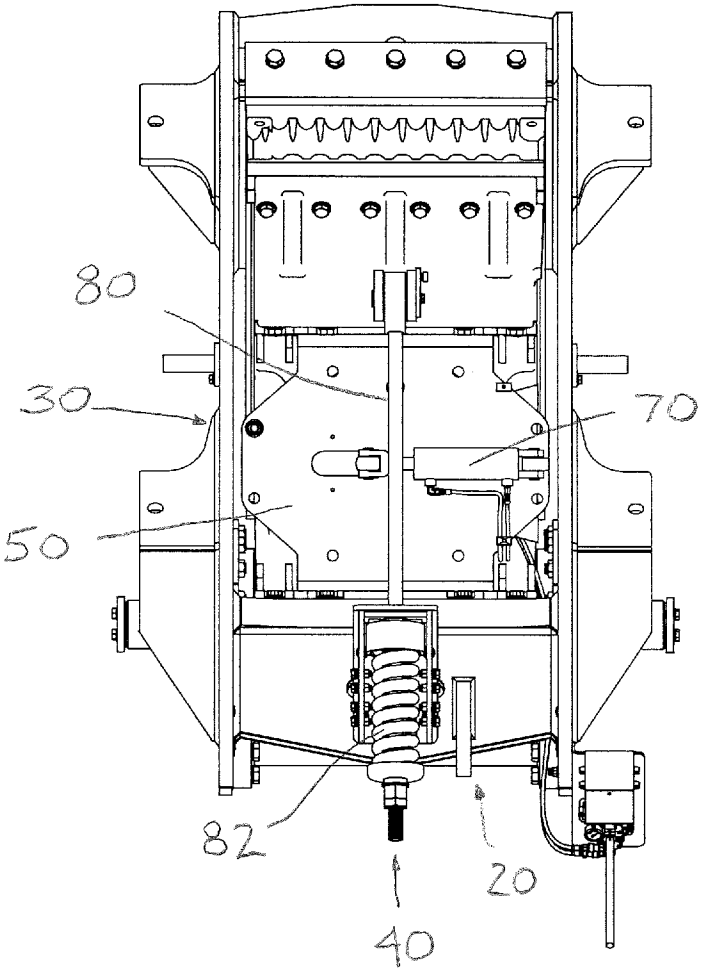
FIG. 2 is a bottom view of the preferred adjustable toggle assembly illustrated in FIG. 1-1A.

Referring now to FIG. 2, a bottom view of preferred adjustable toggle assembly 20 is illustrated. As shown in FIG. 2, preferred adjustable toggle assembly 20 comprises wedge assembly 30 having second cover plate 50 and a means for moving the wedge relative to the first wear bar and the second wear bar such as actuator 70. Preferred actuator 70 is adapted to be moved between a retracted and extended position. In the preferred assembly, the means for moving the wedge relative to the first wear bar and the second wear bar is adapted to move the wedge between a contracted position and an expanded position. Preferred adjustable toggle assembly 20 also comprises tension rod assembly 40 having tension rod 80 and tension rod spring 82.

Referring now to FIG. 2A, a partial sectional bottom view of preferred adjustable toggle assembly 20 is illustrated. As shown in FIG. 2A, second cover plate 50 has been removed in order to illustrate wedge 42, first wear bar 44, and second wear bar 46.

Figure 3:
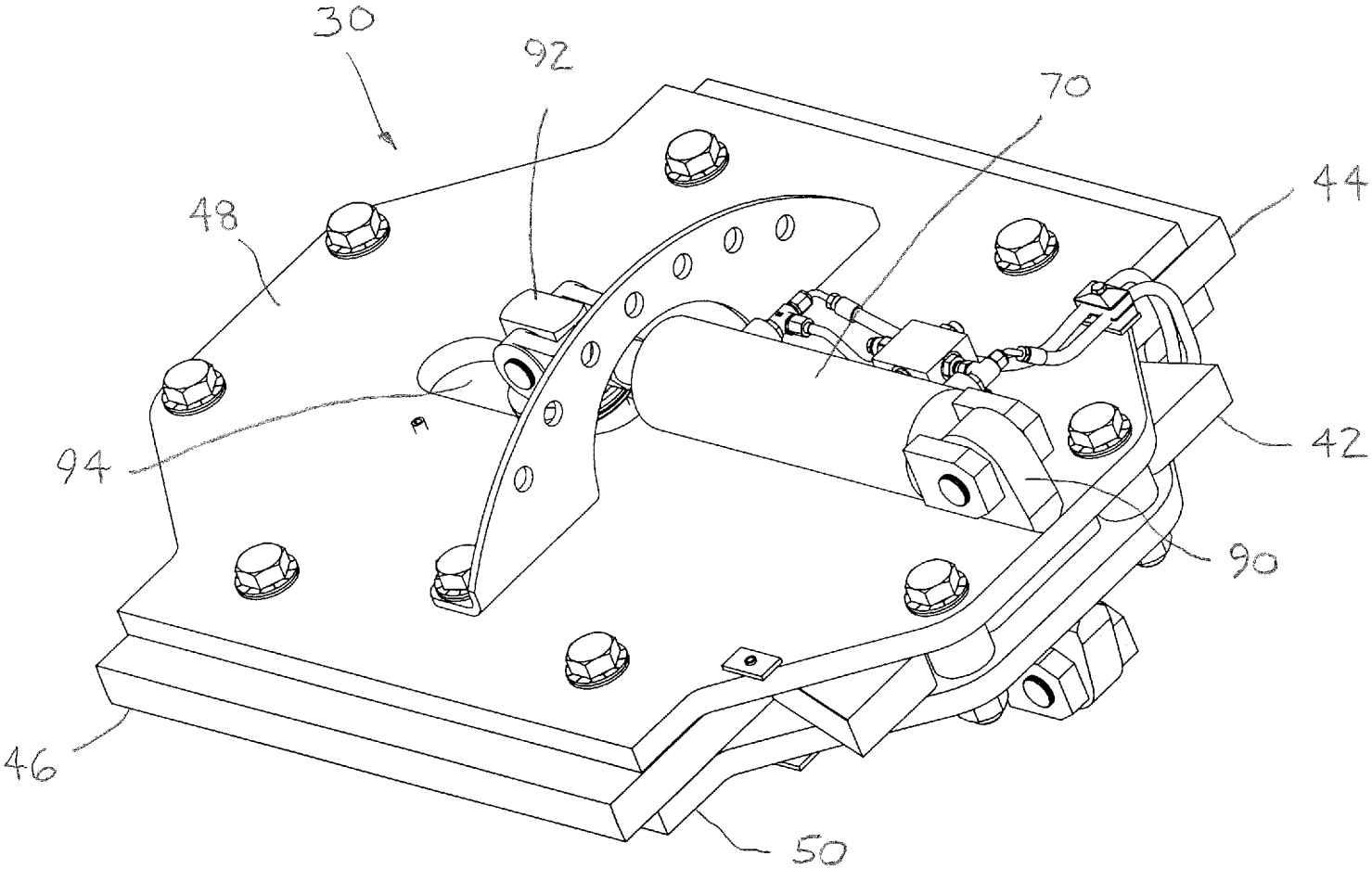
FIG. 3 is a perspective view of the preferred wedge assembly of the adjustable toggle assembly illustrated in FIGS. 1-2.

Referring now to FIG. 3, a perspective view of preferred wedge assembly 30 of adjustable toggle assembly 20 is illustrated. As shown in FIG. 3, preferred wedge assembly comprises wedge 42, first wear bar 44, second wear bar 46, first cover plate 48, and second cover plate 50. Preferred wedge assembly 30 also comprises actuator 70. Preferably, actuator comprises a hydraulic cylinder, but it is contemplated within the scope of the invention that any suitable actuator may be used. Preferred wedge assembly further comprises hydraulic cylinder lug 90, hydraulic cylinder link bar 92, and first cover plate slot 94. In the preferred embodiments of wedge assembly 30, the proximal or base end of actuator 70 is connected to first cover plate 48 and the distal or piston end of actuator 70 is connected to wedge 42. It is also contemplated within the scope of the invention that a second actuator is similarly connected to second cover plate 50 and wedge 42.

Figure 4:
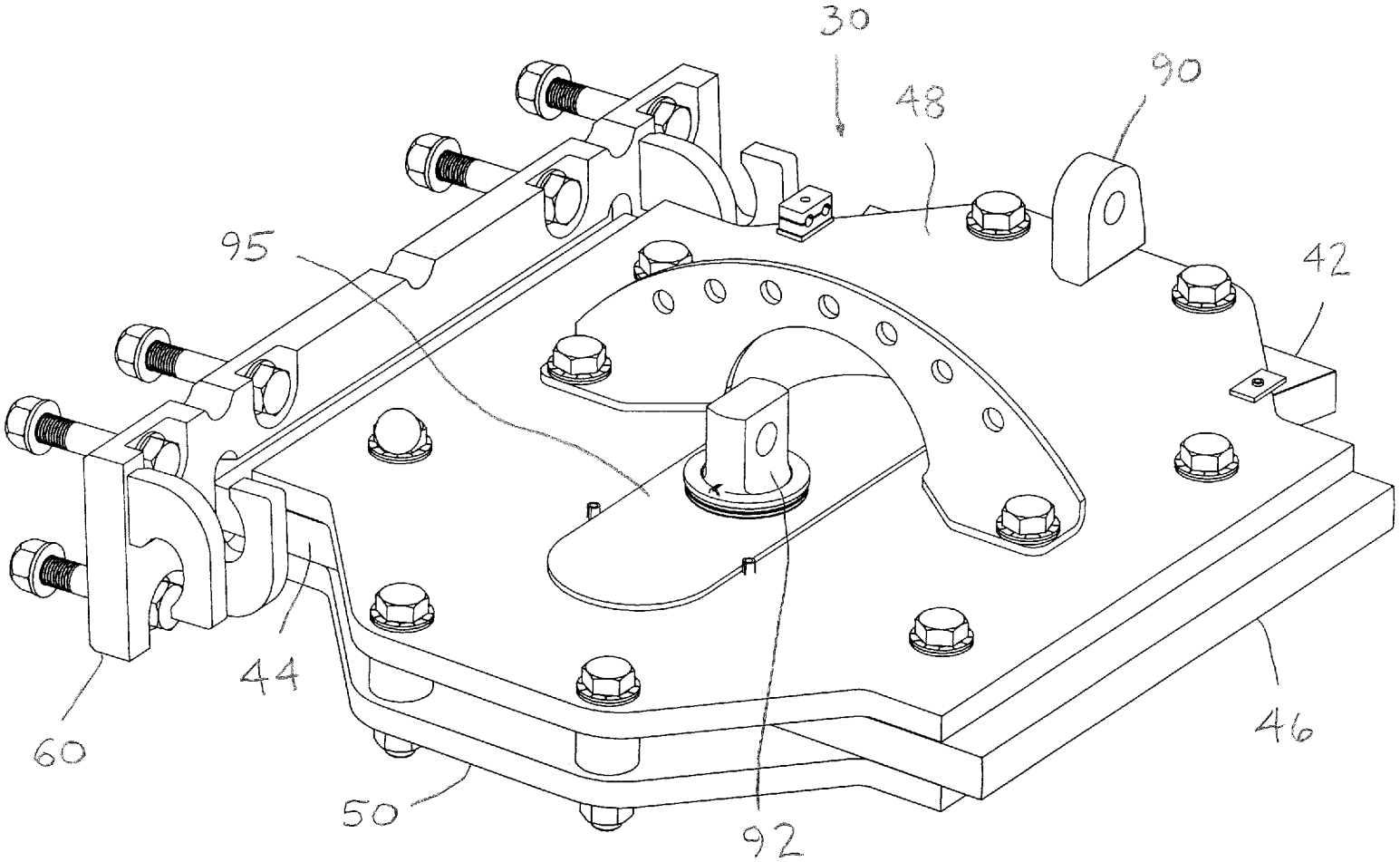
FIG. 4 is a perspective view of the preferred wedge assembly of the adjustable toggle assembly illustrated in FIGS. 1-3.

Referring now to FIG. 4, a perspective view of preferred wedge assembly 30 of adjustable toggle assembly 20 is illustrated. As shown in FIG. 4, preferred wedge assembly 30 comprises wedge 42, first wear bar 44, second wear bar 46, first cover plate 48, second cover plate 50, hydraulic cylinder lug 90, hydraulic cylinder link bar 92, and first cover plate slot cover 95. Also shown in FIG. 4 is first toggle seat 60.

Figure 5:
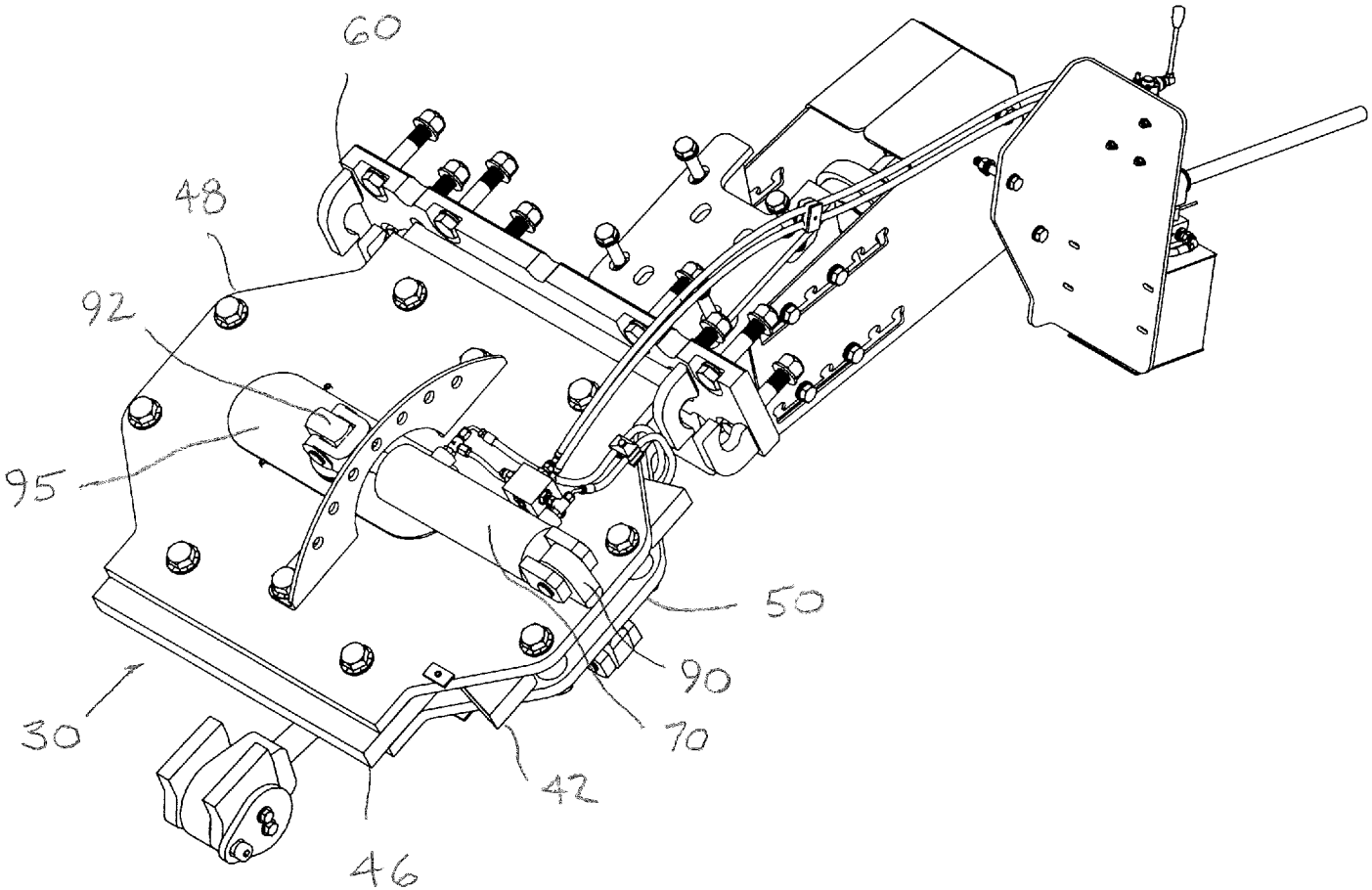
FIG. 5 is a perspective view of the preferred wedge assembly of the adjustable toggle assembly illustrated in FIGS. 1-4.

Referring now to FIG. 5, a perspective view of preferred wedge assembly 30 of adjustable toggle assembly 20 is illustrated. As shown in FIG. 5, preferred wedge assembly 30 comprises wedge 42, second wear bar 46, first cover plate 48, second cover plate 50, first toggle seat 60, actuator 70, hydraulic cylinder lug 90, hydraulic cylinder link bar 92, and first cover plate slot cover 95. Also shown in FIG. 5 are brackets and guards.

Figure 6:
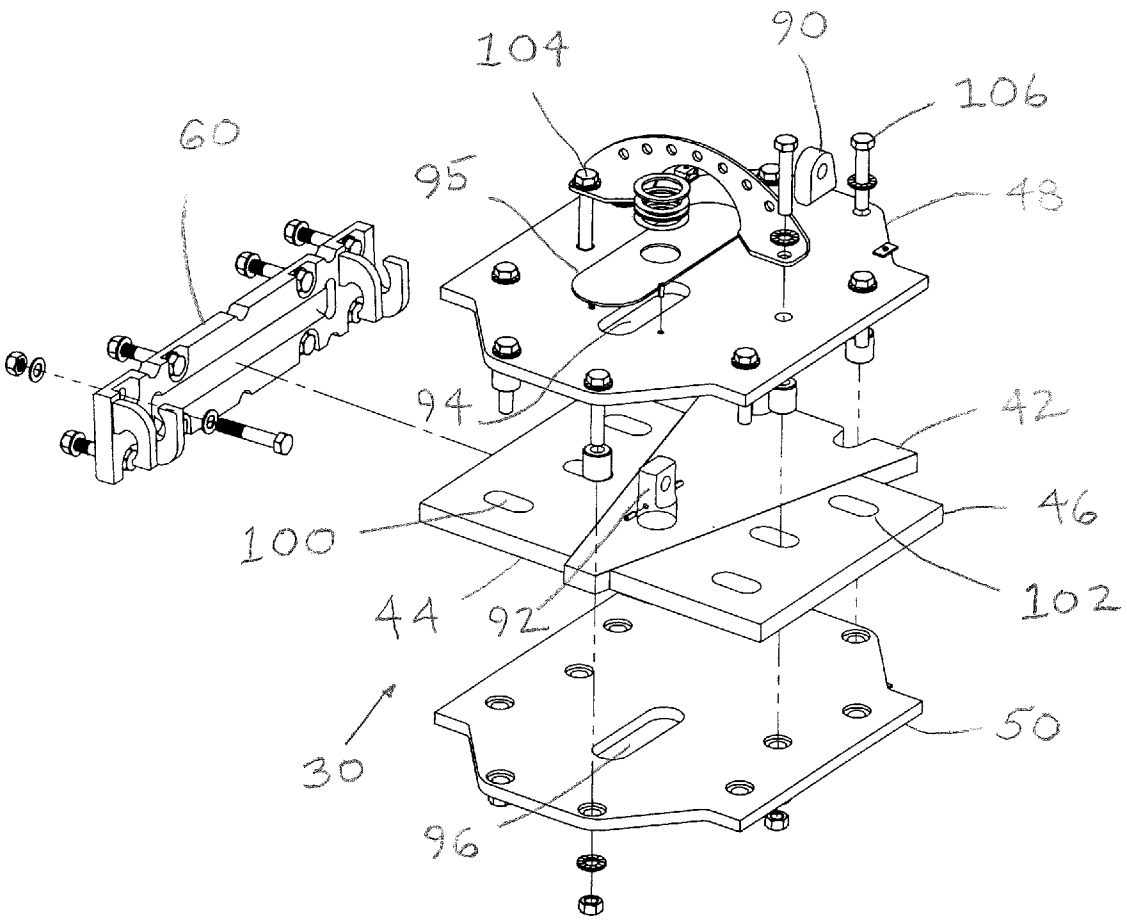
FIG. 6 is an exploded view of the preferred wedge assembly of the adjustable toggle assembly illustrated in FIGS. 1-5.

Referring now to FIG. 6, an exploded view of preferred wedge assembly 30 of adjustable toggle assembly 20 is illustrated. As shown in FIG. 6, preferred wedge assembly 30 comprises wedge 42, first wear bar 44, second wear bar 46, first cover plate 48, second cover plate 50, hydraulic cylinder lug 90, hydraulic cylinder link bar 92, first cover plate slot 94, first cover plate slot cover 95, second cover plate slot 96, first wear bar slots 100, second wear bar slots 102, first wear bar guide bars 104, and second wear bar guide bars 106. Also shown in FIG. 6 is first toggle seat 60.

Figure 7:
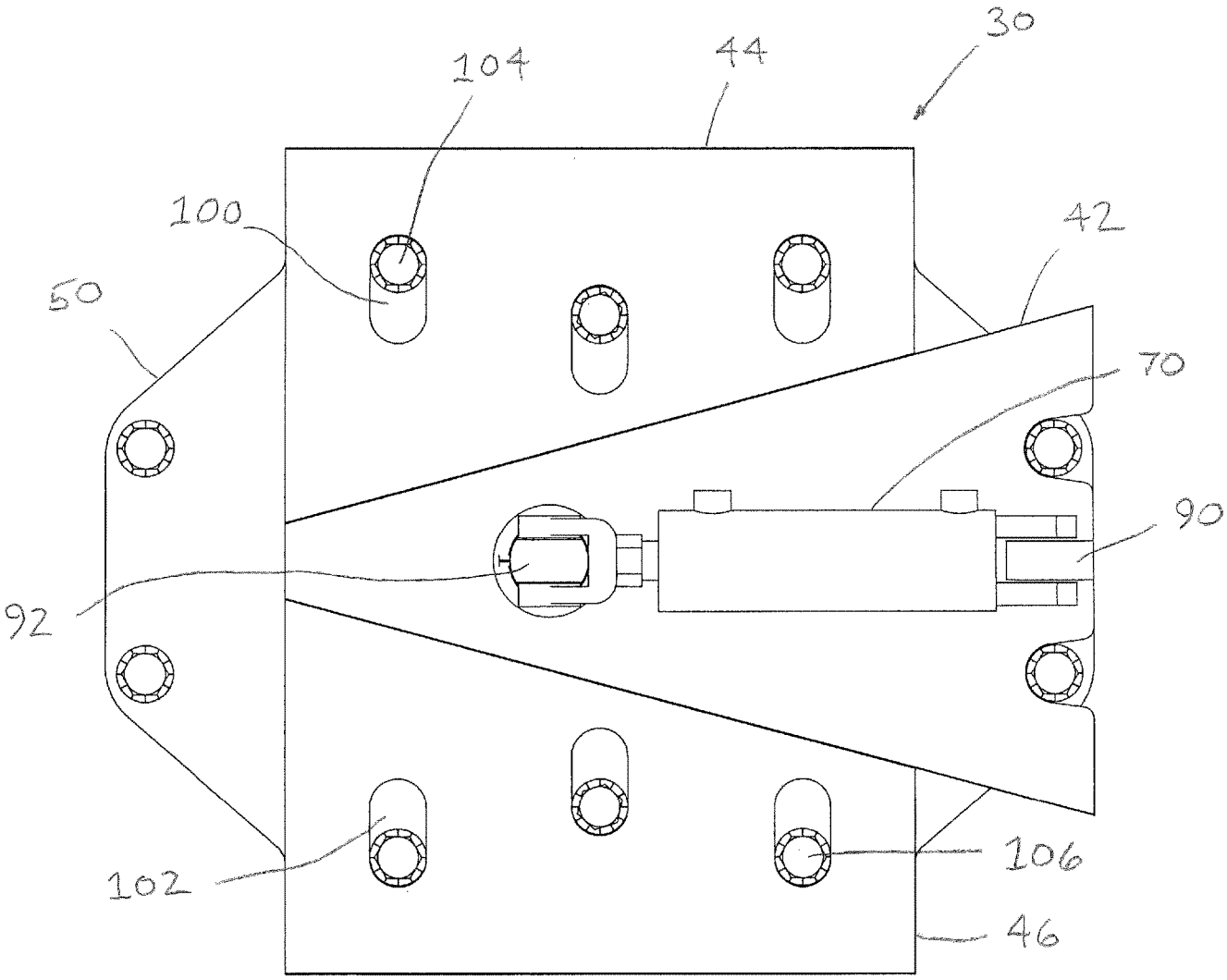
FIG. 7 is a partial sectional view of the preferred wedge assembly of the adjustable toggle assembly illustrated in FIGS. 1-6 showing the actuator in a retracted position.

Referring now to FIG. 7, a partial sectional top view of preferred wedge assembly 30 of adjustable toggle assembly 20 is illustrated with actuator 70 in a retracted position. As shown in FIG. 7, preferred wedge assembly 30 comprises wedge 42, first wear bar 44, second wear bar 46, second cover plate 50, actuator 70, hydraulic cylinder lug 90, hydraulic cylinder link bar 92, first wear bar slots 100, second wear bar slots 102, first wear bar guide bars 104, and second wear bar guide bars 106. Preferred first wear bar guide bars 104 are adapted to be received in first wear bar slots 100 and preferred second wear bar guide bars 106 are adapted to be received in second wear bar slots.

Figure 8:
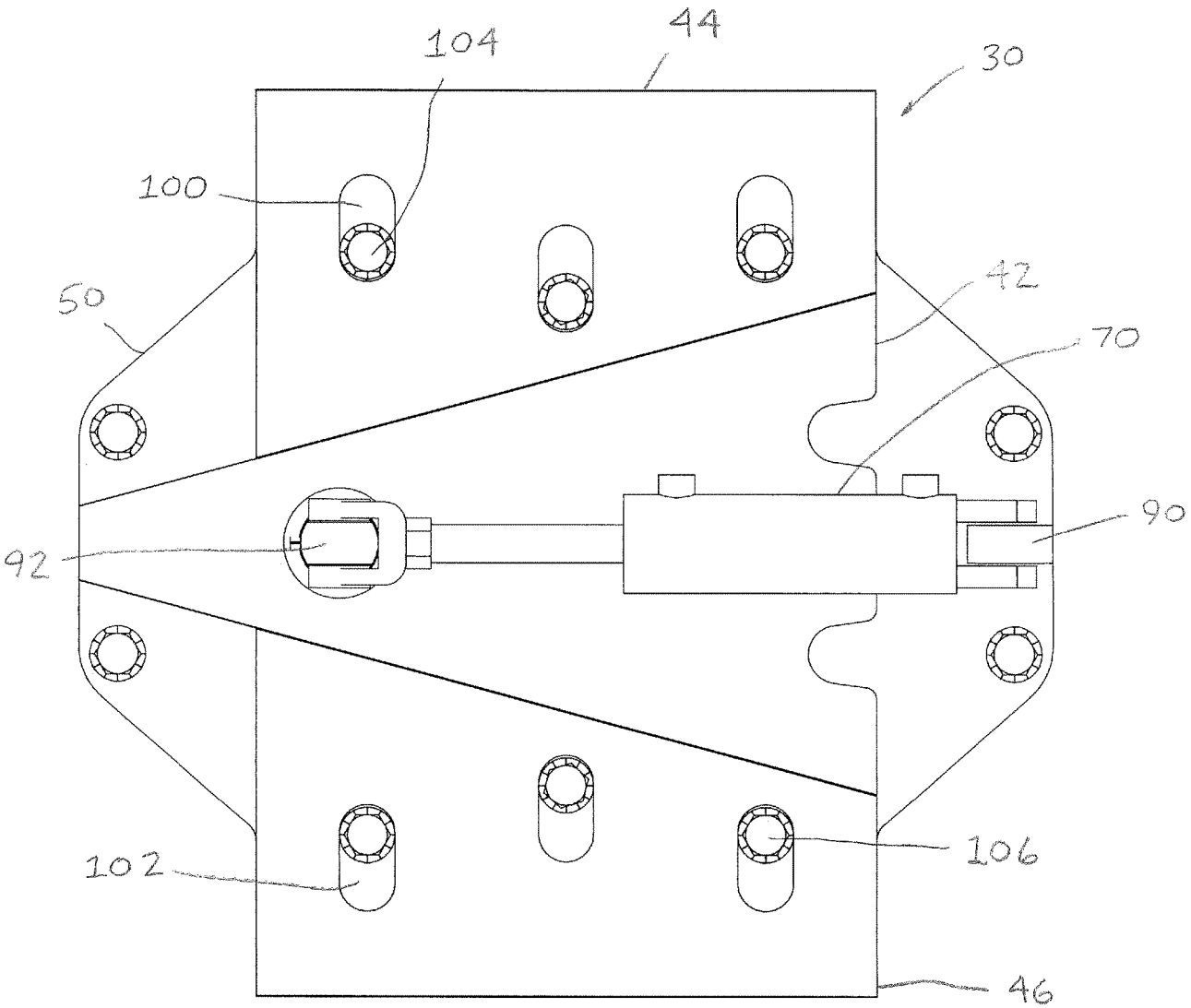
FIG. 8 is a partial sectional view of the preferred wedge assembly of the adjustable toggle assembly illustrated in FIGS. 1-7 showing the actuator in an extended position.

Referring now to FIG. 8, a partial sectional view of preferred wedge assembly 30 of adjustable toggle assembly 20 is illustrated with actuator 70 in an extended position. As shown in FIG. 8, preferred wedge assembly 30 comprises wedge 42, first wear bar 44, second wear bar 46, second cover plate 50, actuator 70, hydraulic cylinder lug 90, hydraulic cylinder link bar 92, first wear bar slots 100, second wear bar slots 102, first wear bar guide bars 104, and second wear bar guide bars 106.

Figure 9:
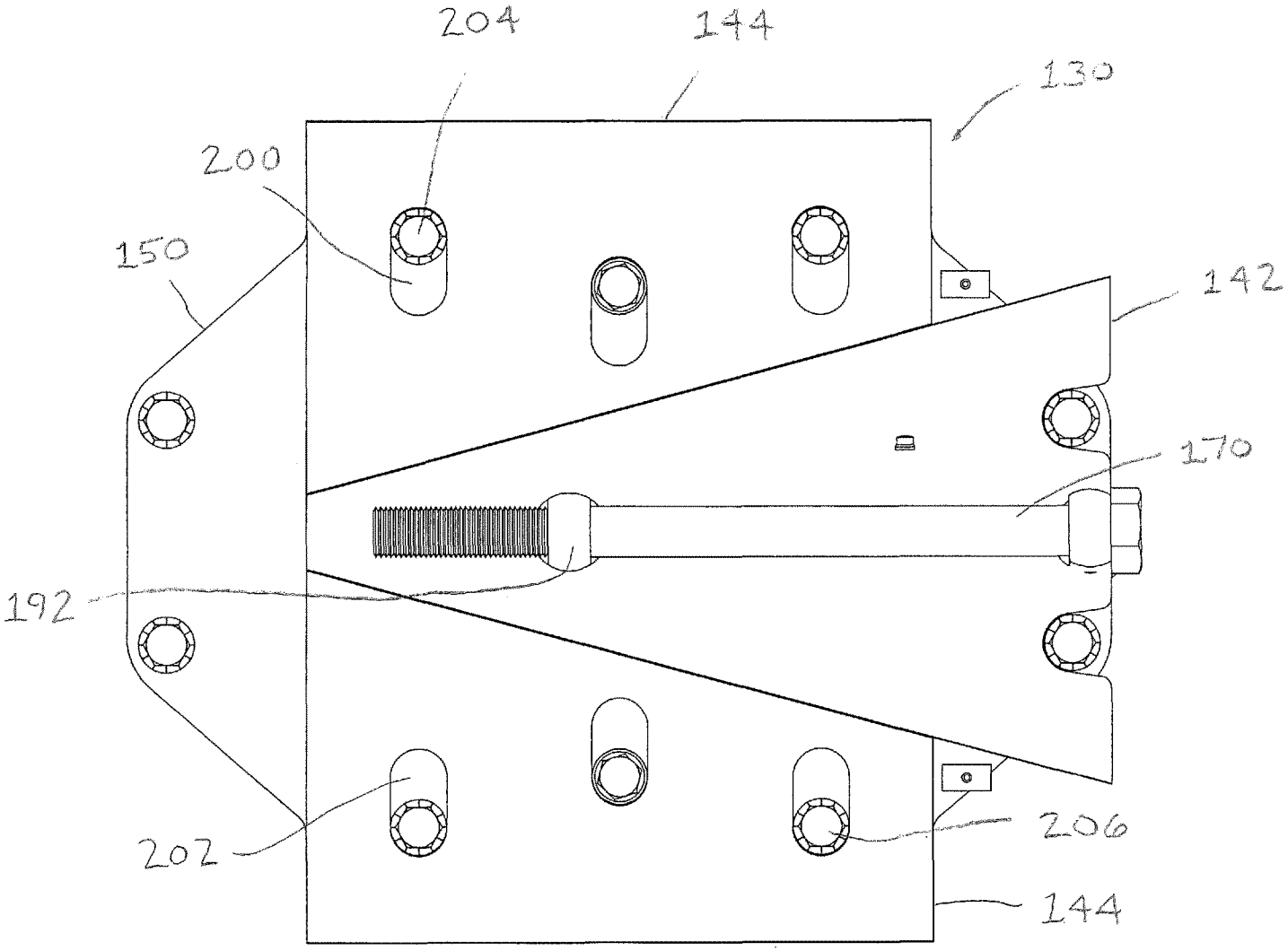
FIG. 9 is a first alternative embodiment of the wedge assembly of the adjustable toggle assembly illustrated in FIGS. 1-8.

Referring now to FIG. 9, a first alternative embodiment of the wedge assembly of the preferred adjustable toggle assembly is illustrated. As shown in FIG. 9, the preferred wedge assembly is designated generally by reference numeral 130. Preferred wedge assembly 130 comprises wedge 142, first wear bar 144, second wear bar 146, second cover plate 150, threaded rod 170, threaded nut 192, first wear bar slots 200, second wear bar slots 202, first wear bar guide bars 204, and second wear bar guide bars 206.

Figure 10:
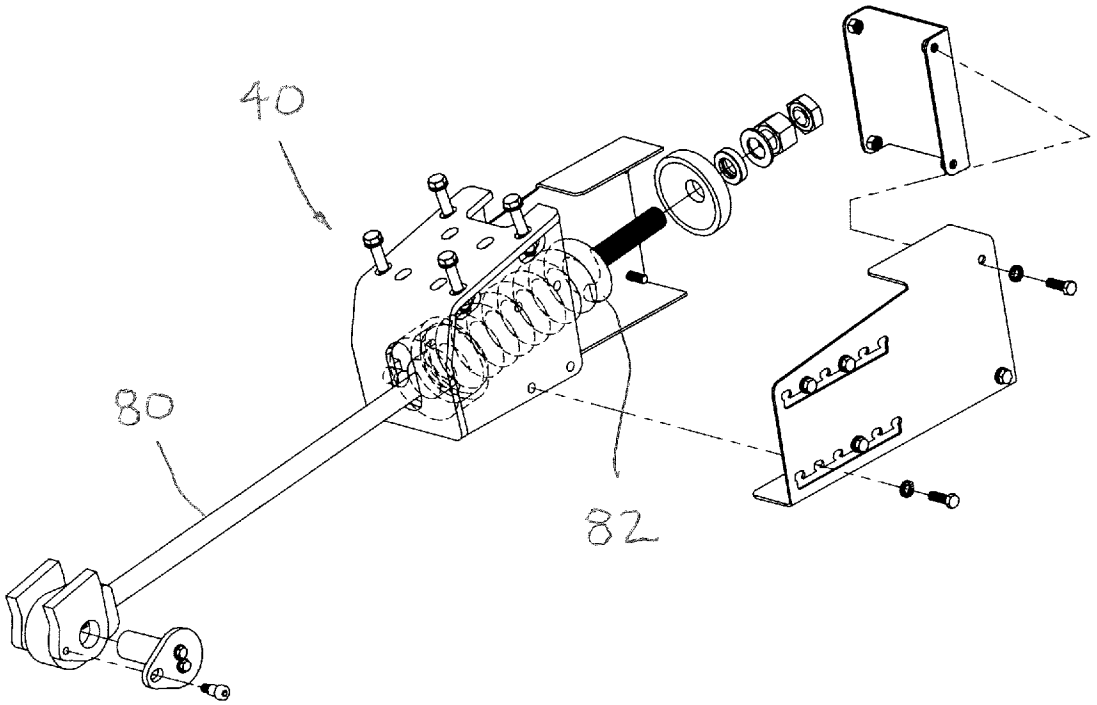
FIG. 10 is an exploded view of the preferred tension rod assembly of the adjustable toggle assembly illustrated in FIGS. 1-9.

Referring now to FIG. 10, an exploded view of preferred tension rod assembly 40 of adjustable toggle assembly 20 is illustrated. As shown in FIG. 10, preferred tension rod assembly 40 comprises tension rod 80 and tension rod spring 82.

Figure 11:
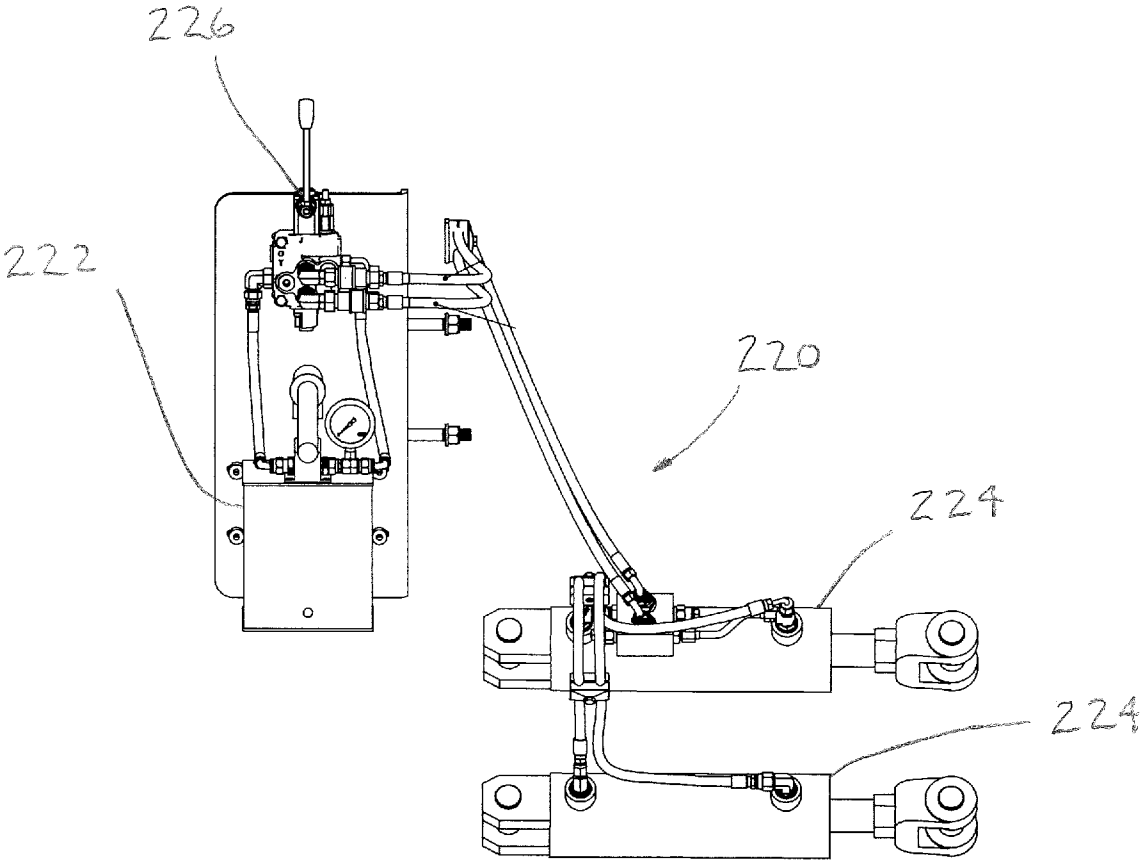
FIG. 11 is a front view of the preferred pump and valve assembly of the adjustable toggle assembly illustrated in FIGS. 1-10.

Referring now to FIG. 11, a front view of the preferred pump and valve assembly of adjustable toggle assembly 20 is illustrated. As shown in FIG. 11, the preferred pump and valve assembly is designated generally by reference numeral 220. Preferred pump and valve assembly 220 comprises pump 222 which is in fluid communication with the means for moving the wedge relative to the first wear bar and the second wear bar such as actuators 224. Preferred pump and valve assembly 220 also comprises first counterbalance valve 226 which is adapted to prevent movement of the means for moving the wedge relative to first wear bar 44 and second wear bar 46 during operation of the item of crushing equipment. In the preferred embodiments comprising a second means for moving the wedge relative to the first wear bar and the second wear bar, preferred pump and valve assembly 220 further comprises a second counterbalance valve which is adapted to prevent movement of the second means for moving the wedge relative to first wear bar 44 and second wear bar 46 during operation of the item of crushing equipment.

The invention also comprise a method for adjusting a toggle assembly adapted for use on an item of crushing equipment having a frame and a jaw. The preferred method comprises providing an adjustable toggle assembly. The preferred assembly comprises a wedge having a wedge top side, a wedge bottom side, and a generally tapered configuration, a first wear bar having a first wear bar top side, a first wear bar bottom side, and being configured to contact the wedge, and a second wear bar having a second wear bar top side, a second wear bar bottom side, and being configured to contact the wedge. The preferred assembly also comprises a first cover plate that is disposed adjacent to the wedge top side, the first wear bar top side, and the second wear bar top side, and a second cover plate that is disposed adjacent to the wedge bottom side, the first wear bar bottom side, and the second wear bar bottom side. The preferred assembly further comprises a means for moving the wedge relative to the first wear bar and the second wear bar. The preferred assembly still further comprises a first toggle seat that is connected to the frame of the item of crushing equipment, and a second toggle seat that is connected to the jaw of the item of crushing equipment. In the preferred assembly, the means for moving the wedge relative to the first wear bar and the second wear bar is adapted to move the wedge between a contracted position and an expanded position, the first wear bar is adapted to contact the first toggle seat, and the second wear bar is adapted to contact the second toggle seat. The preferred method further comprises moving the wedge between the contracted position and the expanded position.

In other preferred embodiments of the method of the invention, the means for moving the wedge relative to the first wear bar and the second wear bar comprises an actuator. The preferred actuator has a proximal end that is connected to the first cover plate and has a distal end that is connected to the wedge and is adapted to move between a retracted position and an extended position. Preferably, the method further comprises moving the actuator between the retracted position and the extended position.

In operation, several advantages of the preferred embodiments of the adjustable toggle assembly are achieved. For example, the preferred embodiments of the adjustable toggle assembly are not undesirably complex and expensive to maintain, repair, and replace. The preferred embodiments of the adjustable toggle assembly do not require undesirably large and expensive hydraulic cylinders because crushing forces are not are not efficiently distributed. The preferred embodiments of the adjustable toggle assembly do not require undesirably expensive and complex programmable logic controllers (PLCs) and hydraulic power units. The preferred embodiments of the adjustable toggle assembly are easily converted between a mechanical toggle assembly and a hydraulic toggle assembly. The preferred embodiments of the adjustable toggle assembly do not have fixed-length toggles and wedges mounted on the frame of the item of crushing equipment. The preferred embodiments of the adjustable toggle assembly have wedges that are wear parts. The preferred embodiments of the adjustable toggle assembly are adapted to change their length and/or the crusher setting.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. An adjustable toggle assembly adapted for use on an item of crushing equipment having a frame and a jaw, said adjustable toggle assembly comprising:

(a) a wedge, said wedge having a wedge top side, a wedge bottom side, and a generally tapered configuration;

(b) a first wear bar, said first wear bar having a first wear bar top side, a first wear bar bottom side, and being configured to contact the wedge;

(c) a second wear bar, said second wear bar having a second wear bar top side, a second wear bar bottom side, and being configured to contact the wedge;

(d) a first cover plate, said first cover plate being disposed adjacent to the wedge top side, the first wear bar top side, and the second wear bar top side;

(e) a second cover plate, said second cover plate being disposed adjacent to the wedge bottom side, the first wear bar bottom side, and the second wear bar bottom side;

(f) a first means for moving the wedge relative to the first wear bar and the second wear bar;

(g) a second means for moving the wedge relative to the first wear bar and the second wear bar and a first counterbalance valve, said first counterbalance valve being adapted to prevent movement of the first means for moving the wedge relative to the first wear bar and the second wear bar during operation of the item of crushing equipment;

(h) a first toggle seat, said first toggle seat being connected to the frame of the item of crushing equipment;

(i) a second toggle seat, said second toggle seat being connected to the jaw of the item of crushing equipment;

wherein the first means for moving the wedge relative to the first wear bar and the second wear bar is adapted to move the wedge between a contracted position and an expanded position; and wherein the first wear bar is adapted to contact the first toggle seat; and wherein the second wear bar is adapted to contact the second toggle seat.

2. The adjustable toggle assembly of claim 1 wherein the first wear bar comprises a first wear bar slot.

3. The adjustable toggle assembly of claim 2 wherein the second wear bar comprises a second wear bar slot.

4. The adjustable toggle assembly of claim 3 further comprising a plurality of guide bars, said guide bars being adapted to be received in either the first wear bar slot or the second wear bar slot.

5. The adjustable toggle assembly of claim 1 wherein the first means for moving the wedge relative to the first wear bar and the second wear bar comprises an actuator.

6. The adjustable toggle assembly of claim 1 wherein the first means for moving the wedge relative to the first wear bar and the second wear bar comprises a hydraulic cylinder.

7. The adjustable toggle assembly of claim 1 wherein the first means for moving the wedge relative to the first wear bar and the second wear bar comprises a threaded rod.

8. The adjustable toggle assembly of claim 6 further comprising a hydraulic cylinder lug.

9. The adjustable toggle assembly of claim 6 further comprising a hydraulic cylinder link bar.

10. The adjustable toggle assembly of claim 1 further comprising a pump, said pump being in fluid communication with the first means for moving the wedge relative to the first wear bar and the second wear bar.

11. The adjustable toggle assembly of claim 1 further comprising a second counterbalance valve, said second counterbalance valve being adapted to prevent movement of the second means for moving the wedge relative to the first wear bar and the second wear bar during operation of the item of crushing equipment.

12. The adjustable toggle assembly of claim 1 further comprising a tension rod.

13. The adjustable toggle assembly of claim 12 further comprising a tension rod spring.

14. An adjustable toggle assembly adapted for use on an item of crushing equipment, said adjustable toggle assembly comprising:

(a) a wedge, said wedge having a wedge top side, a wedge bottom side, and a generally tapered configuration;

(b) a first wear bar, said first wear bar having a first wear bar top side, a first wear bar bottom side, and being configured to contact the wedge;

(c) a second wear bar, said second wear bar having a second wear bar top side, a second wear bar bottom side, and being configured to contact the wedge;

(d) a first cover plate, said first cover plate being disposed on the wedge top side, the first wear bar top side, and the second wear bar top side;

(e) a second cover plate, said second cover plate being disposed on the wedge bottom side, the first wear bar bottom side, and the second wear bar bottom side;

a first actuator, said first actuator having a first actuator proximal end that is connected to the first cover plate and having a first actuator distal end that is connected to the wedge and being adapted to move between a retracted position and an extended position;

(g) a second actuator, said second actuator having a second actuator proximal end that is connected to the first cover plate and having a second actuator distal end that is connected to the wedge and being adapted to move between a retracted position and an extended position;

(h) a pump, said pump being in fluid communication with the first actuator and the second actuator (i) a first counterbalance valve, said first counterbalance valve being adapted to prevent movement of the first actuator during operation of the item of crushing equipment;

(j) a second counterbalance valve, said second counterbalance valve being adapted to prevent movement of the first actuator during operation of the item of crushing equipment;

(k) a first toggle seat, said first toggle seat being connected to the frame of the item of crushing equipment;

(l) a second toggle seat, said second toggle seat being connected to the jaw of the item of crushing equipment;

wherein the first actuator and the second actuator are adapted to move the wedge between a contracted position and an expanded position; and wherein the first wear bar is adapted to contact the first toggle seat; and wherein the second wear bar is adapted to contact the second toggle seat.

15. A method for adjusting a toggle assembly adapted for use on an item of crushing equipment having a frame and a jaw, said method comprising:

(a) providing an adjustable toggle assembly, said adjustable toggle assembly comprising:

(i) a wedge, said wedge having wedge top side, a wedge bottom side, and a generally tapered configuration;

(ii) a first wear bar, said first wear bar having a first wear bar top side, a first wear bar bottom side, and being configured to contact the wedge;

(iii) a second wear bar, said second wear bar having a second wear bar top side, a second wear bar bottom side, and being configured to contact the wedge;

(iv) a first cover plate, said first cover plate being disposed adjacent to the wedge top side, the first wear bar top side, and the second wear bar top side;

(v) a second cover plate, said second cover plate being disposed adjacent to the wedge bottom side, the first wear bar bottom side, and the second wear bar side;

(vi) an actuator for moving the wedge relative to the first wear bar and the second wear bar;

(vii) a first toggle seat, said first toggle seat being connected to the frame of the item of crushing equipment (viii) a second toggle seat, said second toggle seat being connected to the jaw of the item of crushing equipment;

wherein the actuator for moving the wedge relative to the first wear bar and the second wear bar is adapted to move the wedge between a contracted position and an expanded position; and wherein the first wear bar is adapted to contact the first toggle seat; and wherein the second wear bar is adapted to contact the second toggle seat; and wherein the actuator has a proximal end that is connected to the first cover plate and has a distal end that is connected to the wedge;

(b) moving the wedge between the contracted position and the expanded position.

16. The method of claim 15 wherein the actuator is adapted to move between a retracted position and an extended position.

17. The method of claim 16 further comprising moving the actuator between the retracted position and the extended position.

* * * * *